US005794671A

United States Patent [19]

Smith

[11] Patent Number: 5,794,671

[45] Date of Patent: Aug. 18, 1998

[54] RECEPTACLE DRAINER

[76] Inventor: M. Michelle Smith, P.O. Box 123, Milford Square, Pa. 18935

[21] Appl. No.: 800,114

[22] Filed: Feb. 13, 1997

[51] Int. Cl.[6] ..... B65B 1/04; B65B 3/04; B67C 3/00

[52] U.S. Cl. ..... 141/319; 141/363; 141/364; 141/365; 141/366; 141/375; 141/376; 141/378; 248/130

[58] Field of Search ..... 141/319, 363–366, 141/375, 376, 378, 383, 384, 385; 248/125.7, 125.9, 130, 103, 105, 106

[56] References Cited

U.S. PATENT DOCUMENTS

| | | | |
|---|---|---|---|
| 682,576 | 9/1901 | Smith . | |
| 1,806,194 | 5/1931 | Ensslin | 248/130 |
| 2,536,419 | 1/1951 | Brunell et al. | 222/112 |
| 3,860,048 | 1/1975 | White | 141/375 |
| 4,217,941 | 8/1980 | Catalano | 141/372 |
| 4,271,878 | 6/1981 | Bologa | 141/364 |
| 4,399,847 | 8/1983 | McRoberts | 141/364 |
| 4,515,188 | 5/1985 | Brutsman | 141/1 |
| 5,037,046 | 8/1991 | Mingledorff, Jr. | 248/106 |
| 5,092,549 | 3/1992 | Beech | 248/125.9 |
| 5,129,610 | 7/1992 | Campbell | 248/106 |

*Primary Examiner*—David J. Walczak
*Assistant Examiner*—Timothy L. Maust
*Attorney, Agent, or Firm*—Joseph W. Molasky & Associates

[57] ABSTRACT

A draining apparatus for collecting fluids from a container. This device consists essentially of a base and a rotational receptacle support which holds, in place, the container which is to be drained. The container is held in an inverted position and is uniquely secured for draining and can be easily released to facilitate collection and use.

7 Claims, 4 Drawing Sheets

RECEPTACLE DRAINER

This invention relates to a device for draining a residue of liquid from a container.

More particularly, this invention relates to an apparatus which facilitates the recovery of liquids which, because of their viscosity, are tedious to retrieve. Typical of such liquids are, for example, ketchup, honey, syrups, salad dressings, shampoo, hair conditioners, liquid make-up, and similar fluids of a generally viscid nature.

BACKGROUND OF THE INVENTION

It is not uncommon for glutinous fluids to be stored in containers that have a narrow neck. One such example is the ketchup bottle which is tall and includes a neck and mouth of meager dimensions so that the user may control the serving which is to be dispensed.

The difficulty with such containers and their contents is that they do not give up their residues easily and, as a result, the consumer will, as a rule, impatiently discard the bottle and give up on the residue.

On the other hand, those to whom economy is paramount, for example, service providers such as restaurant owners, will usually try and collect these leavings because over a period of time such economies can result in appreciable savings.

A restaurateur, for example, may retrieve from used ketchup bottles sufficient product to fill a container and this, over a period of time, can result in substantial savings.

Various devices have been developed for recovering usable residues from dispensing containers and most as, for example, U.S. Pat. No. 2,536,419 to Brunell et al.; U.S. Pat. No. 3,860,048 to White; U.S. Pat. No. 4,217,941 to Catalano; U.S. Pat. No. 4,271,878 to Bologa; and U.S. Pat. No. 4,399,847, merely provide means for simply holding the container in an inverted position.

Catalano, for example, drains the contents of the bottle into a "like bottle" and includes "rapping means" for shaking loose the contents which are sought to be drained.

Brunell et al, on the other hand, describes a stand with an upper support means and a lower, funnel-shaped support means. The bottle is placed into the stand and the fluid is allowed to drain through a funnel and into a container.

Bologa provides a molded draining device having a configured opening into which the neck of the bottle to be drained is inserted in an inverted position. Included within the opening are resilient "fingers" which cradle the neck of the bottle so that it can be held securely while the contents drain.

SUMMARY OF THE INVENTION

This invention is an improvement over known receptacle drainers because it provides a more economical, efficient and easier-to-use means for recovering liquid residues from narrow-necked containers.

Also, the drainer of this invention has broad application because it will accommodate receptacles of various size and shape.

This invention also provides a portable and foldable device which can be erected and taken down quickly with little or no effort and which, in its erected or operable mode, occupies very little space. Accordingly, it is ideally suited for areas in which space is at a premium as, for example, a kitchen, bathroom, or workshop.

In its broadest aspects, this invention provides for the draining of fluids from a receptacle. Structurally, it is comprised of a base frame and a receptacle support frame coupled to the base and having an ability to rotate 360°.

According to one embodiment, the receptacle support frame is comprised of a base frame and two trunnions between which the receptacle is rotatably held. Both trunnions are end-mounted to the frame, but only one is adjustable.

In another embodiment, the adjustable trunnion consists essentially of an adjustable trunnion arm to which there is joined a rotational cradle member. The adjustable trunnion arm may contain an adjustable sleeve which is coupled to the mounting end of the adjustable trunnion including an adjustable trunnion arm shaft having a serrated end slidably inserted into the adjustable sleeve. The serrated end contains a thumb screw which, when tightened, prevents the movement of the adjustable trunnion arm shaft within the adjustable sleeve.

A preferred form of the rotational member provides for a cradle having a serrated end. In this embodiment, the serrated end of the cradle is rotatably coupled to the adjustable trunnion arm shaft to provide enhanced rotational means.

A preferred form of the base frame provides for a plurality of supporting legs, the ends of which include a mounting tab and a hinge. The receptacle support frame includes a non-adjustable trunnion and an adjustable trunnion, both of which are equipped with mounting ends having a slot and a slot opening. The receptacle support frame is joined to the base frame by inserting the mounting tab of each leg is into the opening and the hinge of each leg is inserted into each accommodating slot.

A preferred form of the non-adjustable trunnion consists essentially of a non-adjustable trunnion arm coupled to the mounting end of a non-adjustable trunnion equipped with a serrated end. A cradle having a serrated end is rotatably coupled to the non-adjustable trunnion arm by coupling the serrated end of the non-adjustable trunnion arm to the serrated end of the cradle.

In an alternative embodiment, the receptacle support frame comprises first and second trunnions, each having a mounting end for mounting the trunnions to the base frame, and including strapping means for supporting the receptacle. This strapping means is comprised of a strap that is adjustable to support bottles of varying sizes and shapes.

This invention will now be described with particularity by reference to the Drawings.

DESCRIPTION OF THE PREFERRED EMBODIMENTS

Figure 1:
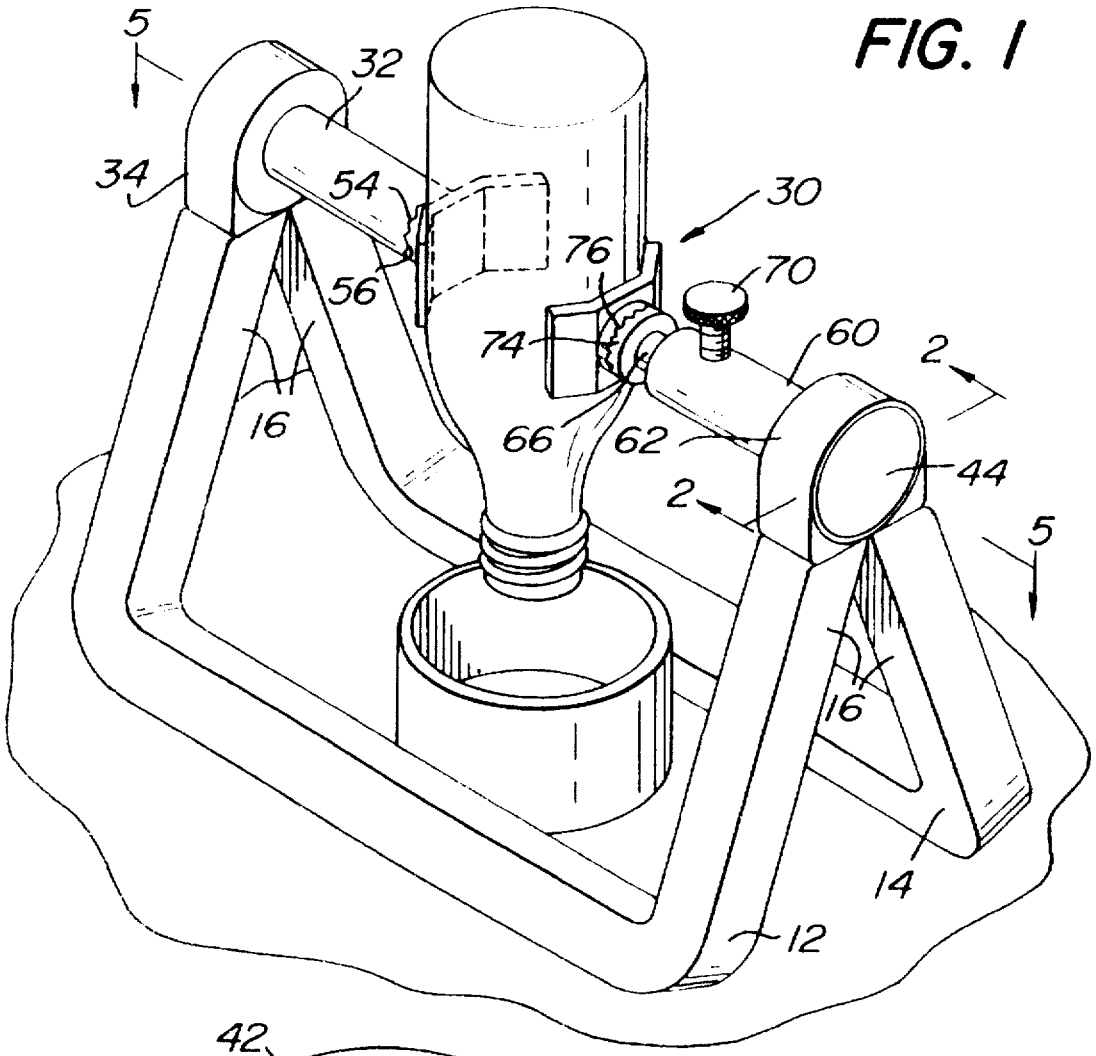
FIG. 1 is a perspective view of a drainer assembly according to this invention.
Figure 2:
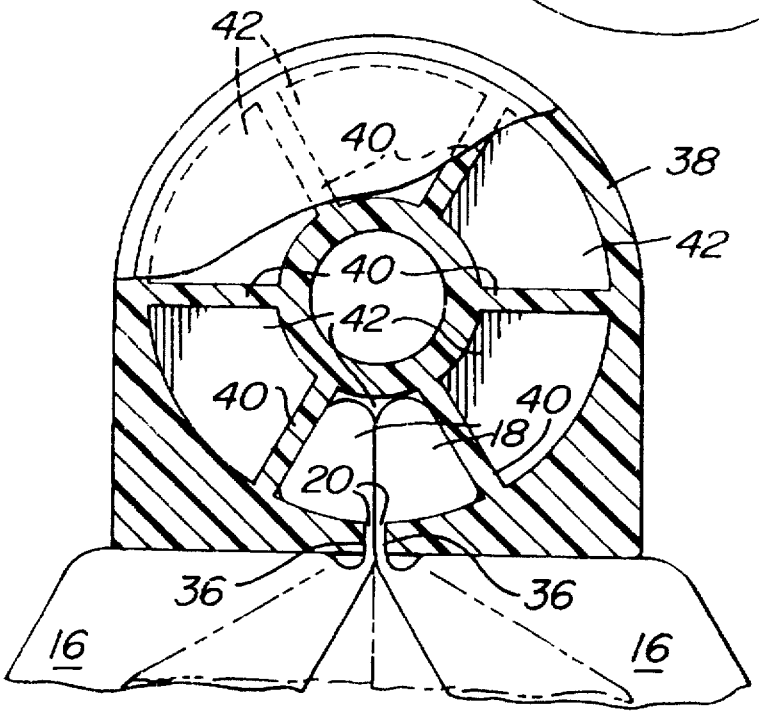
FIG. 2 is a cross-sectional view taken along line 2—2 of FIG. 1.

FIG. 1 is a perspective view of a first embodiment of the present invention. This embodiment is comprised of a base frame 10 and a receptacle support frame 30. Base frame 10 is comprised of a pair of legs 12 and 14 which are characterized by their generally U-shaped configuration. The end 16 of each leg 12 and 14 (see FIG. 2) includes a tab 18 and a "living hinge" 20. The term "living hinge" as used herein refers to a thin piece of flexible material, e.g., soft plastic, which can be flexed repeatedly in the manner of a conventional hinge.

The receptacle support frame 30 consists essentially of a non-adjustable trunnion 32 and an adjustable trunnion 60. The non-adjustable trunnion has a mounting end 34, and the adjustable trunnion 60 has an identical mounting end 62. As shown in detail in FIG. 2, each mounting end (34 or 62) includes a slot 36, an open end 38, spokes 40, spoke openings 42, and an end cap 44. The tabs 18 and living hinge 20 of the ends 16 fit into the slot 36 and the bottom spoke opening 42, that is, the slot 36 is wide enough to accommodate two living hinges 20 (one for leg 12 and one for leg 14) and the bottom spoke opening 42 may accommodate two tabs 18 (one for leg 12 and one for leg 14). The legs 12 and 14 move between an open position (shown in standard lines in FIG. 2) and a closed position (shown in phantom lines in FIG. 2). This enables the device to be manipulated to a folded position for storage when not in use.

The end cap 44 fits over the open end 38 of each of the mounting ends of the trunnions, and its primary function is to prevent dirt and other unwanted material from becoming lodged in the spoke openings 42.

Figure 4:
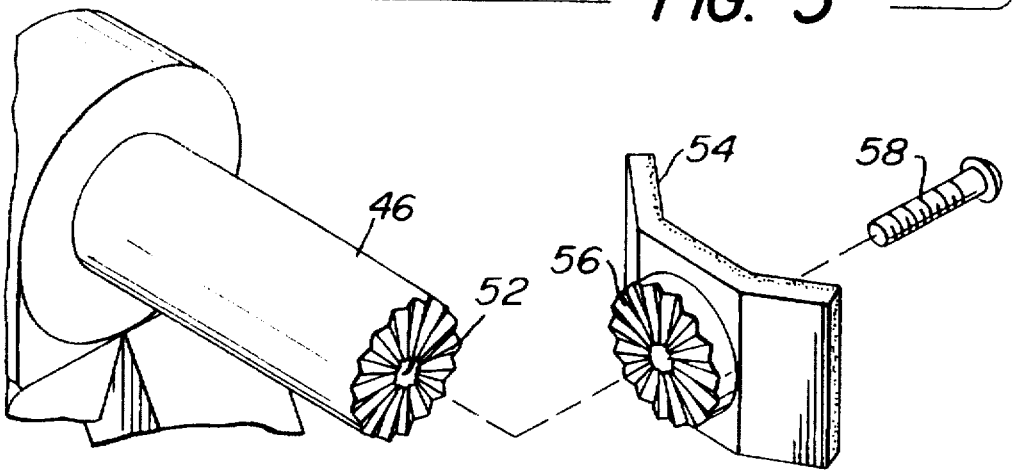
FIG. 4 is an exploded perspective view of the non-adjustable securing member shown in FIG. 1.
Figure 5:
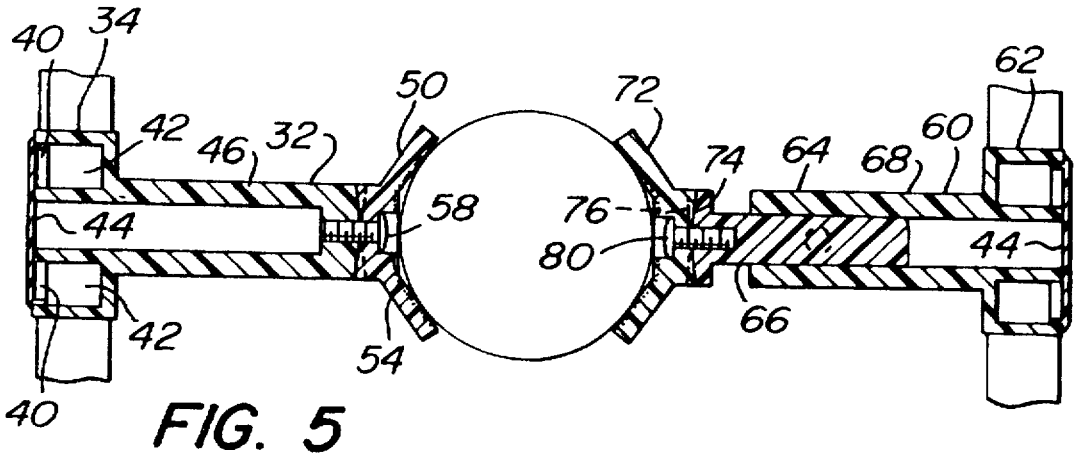
FIG. 5 is a cross-sectional view taken along line 5—5 of FIG. 1.
Figure 6:
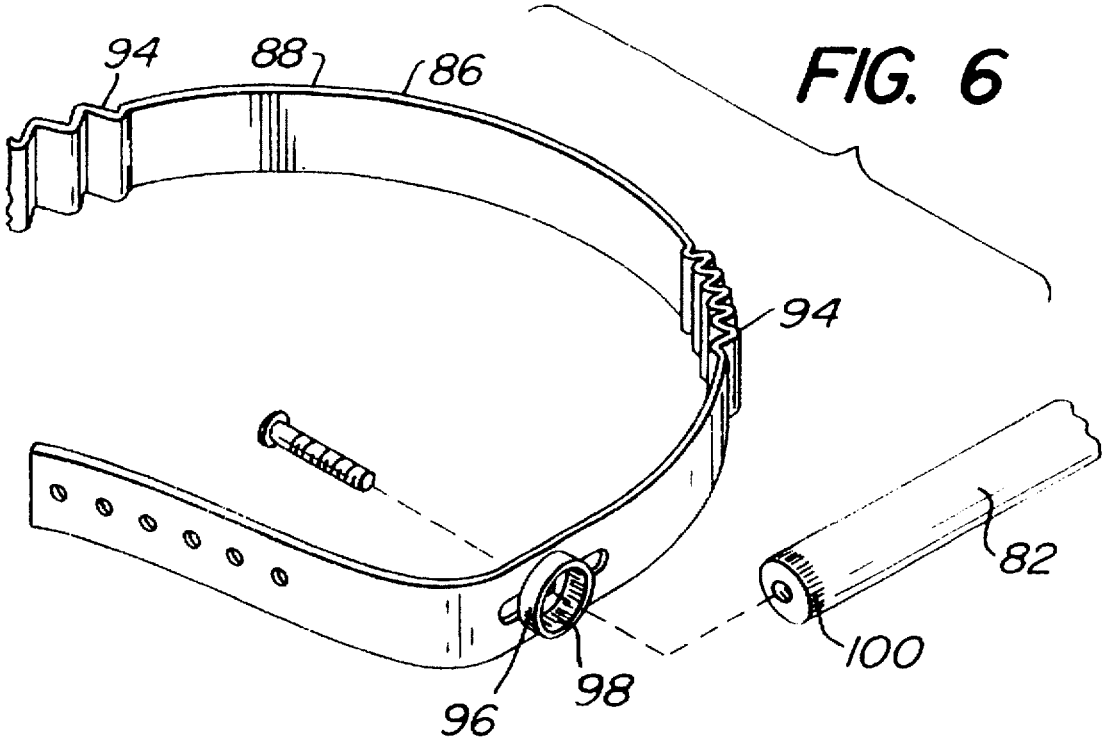
FIG. 6 is an exploded perspective view of an alternative securing means for a drainer assembly of this invention.
Figure 7:
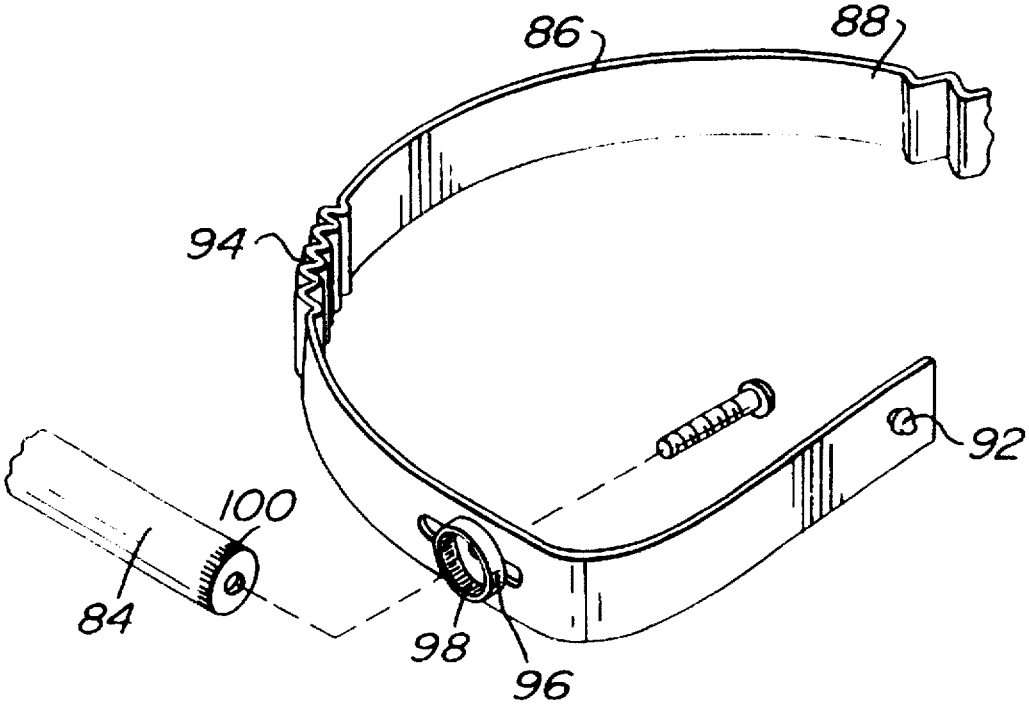
FIG. 7 is an exploded perspective view of an alternative securing means.

Referring now to FIGS. 1, 4, and 5, it will be seen that the non-adjustable trunnion 32 further comprises trunnion arm 46 and a rotational cradle member 50 which is equipped with a cradle 54 having a serrated portion 56 and a screw 58. The serrated portion 52 "mates" with serrated portion 56, and screw 58 loosely secures cradle 54 to trunnion arm 46. When coupled in this manner, the cradle 54 is moveable about the longitudinal axis of trunnion arm 46; the serrated portions 52 and 56 allow this movement to occur, but only when urged to move in the manner described hereinbelow.

Figure 3:
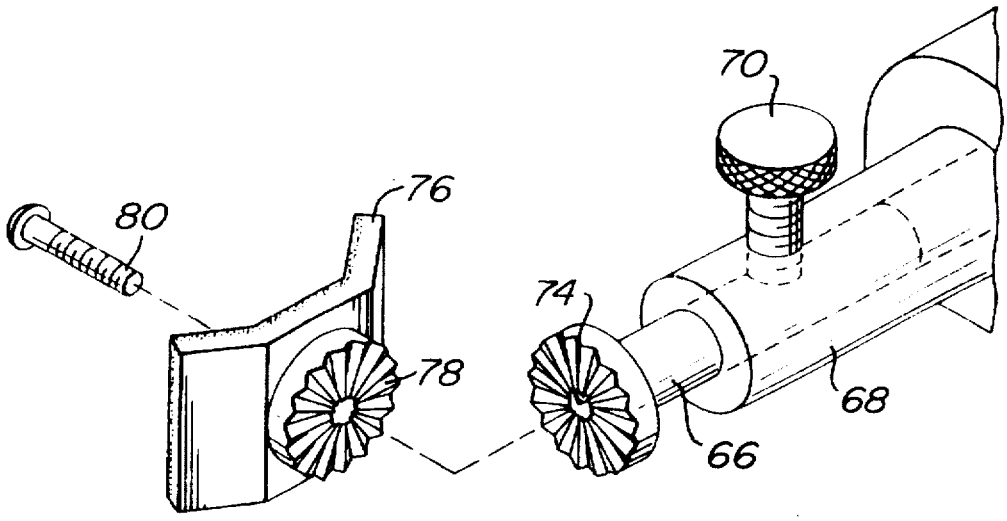
FIG. 3 is an exploded perspective view of the adjustable securing member shown in FIG. 1.

Referring now to FIGS. 1, 3, and 5, adjustable trunnion 60 includes an adjustable trunnion arm 64 and a rotational cradle member 72. The adjustable trunnion arm 64 is comprised of an adjustable trunnion-arm shaft 66 which is slidably inserted into adjustable trunnion-arm sleeve 66 and includes, at its end segment, a serrated portion 74. A thumb screw 70 is threaded into the adjustable trunnion-arm sleeve 68 as shown, perpendicular to the longitudinal axis thereof. Upon loosening thumb screw 70 and moving adjustable trunnion-arm shaft 66 in or out of adjustable trunnion-arm sleeve 68, the effective length of the adjustable trunnion arm 64 may be adjusted to accommodate receptacles of various size.

Rotational cradle member 72 is essentially identical to rotational cradle member 50, that is, it includes rotational cradle member 72, a cradle 76 having a serrated portion 78, and a screw 80 for holding the cradle 76 which is rotatably coupled to serrated portion 74. The serrated portion 74 "mates" with serrated portion 78, and screw 80 loosely secures cradle 76 to trunnion-arm shaft 66. When coupled in this manner, the cradle 76 is moveable about the longitudinal axis of trunnion-arm shaft 66, and the serrated portions 74 and 78 allow this movement to occur but only when urged to move in the manner described hereinbelow.

In lieu of the adjustable trunnion 60 and the rotatable cradle members 50 and 72, an alternative embodiment of the type shown in FIGS. 6–9 may be employed. In this embodiment, trunnion arms of fixed length (82 and 84) are employed together with a strapping means 86 which may be adjusted to accommodate bottles of various size. Strapping means 86 includes a strap 88 having a series of adjustment holes 90 and a securing stud 92. The size of the loop formed by the strap 88 may be enlarged or lessened by drawing on the strap 88 and inserting the securing stud 92 into an appropriate adjustment hole 90. The strap includes fluted segments 94 which can be stretched to provide for minor adjustments; these fluted segments 94 are "accordion-like" and, therefore, they can be stretched and adjusted as needed to accommodate containers of various size and shape.

Figure 8:
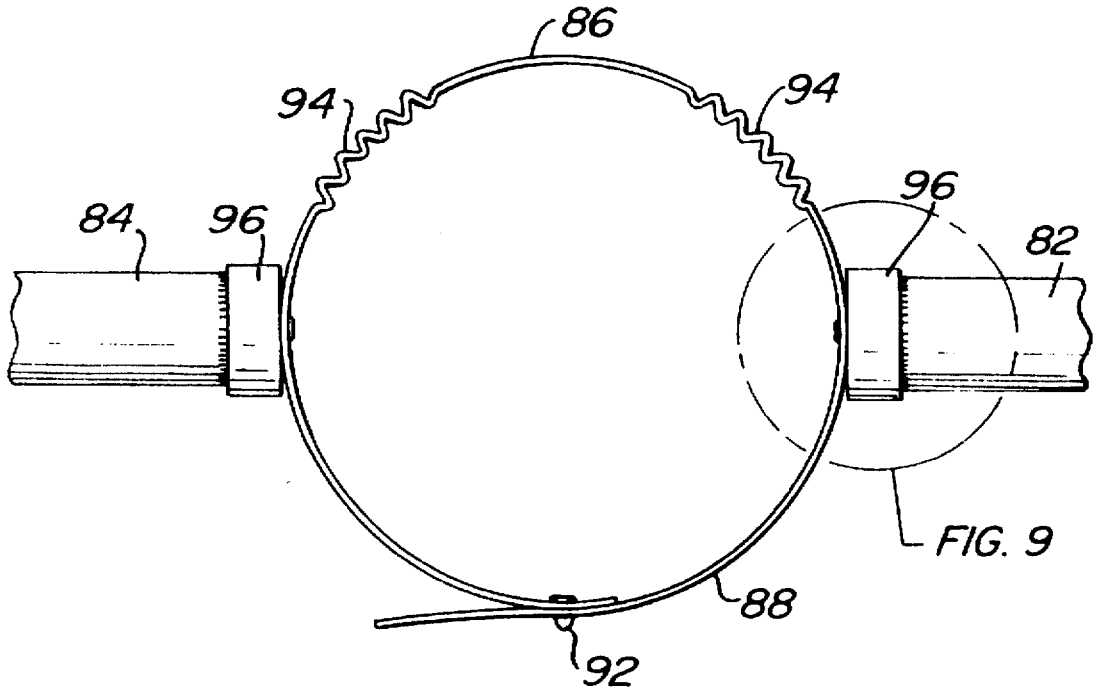
FIG. 8 is a top view of the alternative securing means shown in FIG. 6.
Figure 9:
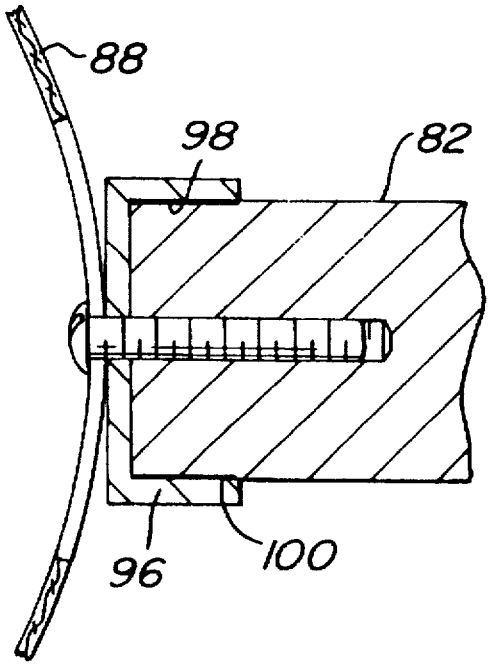
FIG. 9 is an cross-sectional view of the securing means which is encircled in FIG. 8.

In the embodiment shown in FIGS. 6–9, the rotatable connection between the trunnion arms 82 and 84 and the strapping means 86 comprises a socket 96 that has a knurled surface 98 formed therein. On the end of the trunnion arms 82 and 84, a complimentary knurled surface 100 is formed. When the knurled ends of the trunnion arms are inserted into the sockets 96 as shown in FIGS. 8 and 9, the knurling provides "click-stops" similar to those described with respect to the serrated portions of the previously described embodiment.

To operate the embodiment shown in FIGS. 1–5, the user first loosens thumbscrew 70 and pushes the adjustable trunnion-arm shaft 66 into adjustable trunnion-arm sleeve 66, so that the receptacle can be fitted between the two cradles 54 and 76. The receptacle is then placed between the support cradles 54 and 76 and the adjustable trunnion-arm shaft 66 is pulled out of the adjustable trunnion-arm sleeve 68 until the receptacle is tightly gripped by the two cradles 54 and 76. Once secured between the cradles, a receiving container is placed under the bottle and the bottle is rotated to an upside-down position. The serrated portions provide 'click-stops' so that a receptacle held between the rotational cradle members can be rotated 360° if desired, and it can also be positioned at any desired angle by simply bringing the receptacle to rest at a chosen 'click-stop'. The contents of the bottle, acted upon by the forces of gravity, will drain from the bottle and into the receiving container.

The embodiment shown in FIGS. 6–9 is employed in an essentially identical manner. The difference lies in the manner in which the bottle is secured. Specifically, the user loosens the strapping means 86 by disengaging the adjustment holes from the securing stud 92 and the bottle is then placed inside the strap 88 and the strap tightened. The appropriate adjustment hole 90 and the securing stud 92 are then brought into engagement so as to provide a secure holding means for the inverted bottle.

While the preferred embodiments have been fully described and depicted for the purposes of explaining the principles of the present invention, it will be appreciated by those skilled in the art that modifications and changes may be made thereto without departing from the spirit and scope of the invention set forth in the appended claims.

What is claimed is:

1. An apparatus for draining fluid from a receptacle, comprising:

a base frame;

a receptacle support frame coupled to said base frame and comprising an adjustable trunnion having a mounting end for mounting said adjustable trunnion on said base frame; and a non-adjustable trunnion having a mounting end for mounting said non-adjustable trunnion to said base frame, wherein the adjustable trunnion is adjusted with respect to said non-adjustable trunnion until said receptacle is held between said trunnions, for enabling said receptacle to be rotated 360° when said receptacle is supported by said receptacle support frame.

2. An apparatus as set forth in claim 1, wherein said adjustable trunnion comprises:

an adjustable trunnion arm; and a rotational cradle member attached to said adjustable trunnion arm.

3. An apparatus as set forth in claim 2, wherein said adjustable trunnion arm comprises:

an adjustable trunnion arm sleeve coupled to said mounting end of said adjustable trunnion;

an adjustable trunnion arm shaft, slidably inserted into said adjustable trunnion sleeve and having a serrated end; and a thumb screw for prevent the movement of said adjustable trunnion arm shaft within said adjustable trunnion arm sleeve when said thumb screw is tightened.

4. An apparatus as set forth in claim 3, wherein said rotational cradle member comprises a cradle having a serrated end, wherein said cradle is rotatably coupled to said adjustable trunnion arm shaft by coupling the serrated end of said adjustable trunnion arm shaft to said serrated end of said cradle.

5. An apparatus as set forth in claim 1, wherein said base frame comprises a plurality of legs having ends, each of said ends comprising:

a mounting tab; and a hinge; and wherein each of said mounting ends of the non-adjustable trunnion and the adjustable trunnion includes a slot and an opening, wherein said mounting tab of each leg is insertable into said opening and said hinge of each leg is insertable into said slot, thereby coupling said receptacle support frame to said base frame.

6. An apparatus as set forth in claim 1, wherein said non-adjustable trunnion comprises:

a non-adjustable trunnion arm coupled to said mounting end of said non-adjustable trunnion end having a serrated end; and a cradle having a serrated end, where said cradle is rotatably coupled to said non-adjustable trunnion arm by coupled the serrated end of said non-adjustable trunnion arm to said serrated end of said cradle.

7. An apparatus as set forth in claim 3, wherein said non-adjustable trunnion comprises:

a non-adjustable trunnion arm coupled to said mounting end of said non-adjustable trunnion and having a serrated end; and a cradle having a serrated end, wherein said cradle is rotatably coupled to said non-adjustable trunnion arm by coupling the serrated end of said non-adjustable trunnion arm to said serrated end of said cradle.

* * * * *